US005566481A

United States Patent [19]

Lehrman

[11] Patent Number: 5,566,481

[45] Date of Patent: Oct. 22, 1996

[54] IRONING BOARD COVER WITH SCORCH RESISTANT PANEL

[76] Inventor: David Lehrman, 207 Barclay Cir., Cheltenham, Pa. 19012

[21] Appl. No.: 369,236

[22] Filed: Jan. 6, 1995

[51] Int. Cl.[6] ..... D06F 83/00

[52] U.S. Cl. ..... 38/140; 38/107

[58] Field of Search ..... 38/140, 106, 107, 38/142, 140; 150/164; 156/90

[56] References Cited

U.S. PATENT DOCUMENTS

| | | | |
|---|---|---|---|
| 1,659,427 | 2/1928 | Danielson | 38/107 |
| 2,267,112 | 12/1941 | Kovalik | 38/140 |
| 2,539,804 | 1/1951 | Ademic | 38/107 |
| 2,850,817 | 9/1958 | Rudd et al. | 38/140 |
| 3,636,644 | 1/1972 | Janetzke | 38/140 |
| 3,911,603 | 10/1975 | Lehrman | 38/140 |
| 4,120,914 | 10/1978 | Behnke et al. | 260/857 TW |

*Primary Examiner*—Ismael Izaguirre

*Attorney, Agent, or Firm*—Seidel, Gonda, Lavorgna & Monaco, P.C.

[57] ABSTRACT

The present invention defines an ironing board cover assembly including a cover and a scorch resistant panel. The scorch resistant panel is secured to and flush with the cover and forms a pocket therebetween. A heat resistant panel is located in the pocket between the scorch resistant panel and the cover. The ironing board cover assembly further includes a bumper provided along the perimeter of the scorch resistant panel. The bumper has a height of at least ⅓ of an inch (8.46 mm) and partially surrounds the scorch resistant panel.

22 Claims, 1 Drawing Sheet

IRONING BOARD COVER WITH SCORCH RESISTANT PANEL

FIELD OF THE INVENTION

This invention relates to an ironing board cover having a layer of fabric and a safety panel for resting a hot iron in its horizontal operative position. The safety panel is provided flush with the layer of fabric and is partially enclosed by a bumper that prevents the iron from sliding over the edge of the ironing board.

BACKGROUND OF THE INVENTION

Ironing boards have typically included areas for resting hot irons as either extensions to the ironing board or as discreet regions of the ironing board cover.

U.S. Pat. No. 1,292,977 to Wilson is an example of an ironing board having an extension for resting a hot iron in its horizontal operative position. The extension includes a corrugated section having opposing sides and a rear edge flange. Further examples are found in U.S. Pat. Nos. 1,651,427, 1,659,427, 1,784,959 of other similar structures.

U.S. Pat. No. 1,403,088 to Lefkovits is an example of an ironing board cover in which a scorch resistant layer has been provided in a pocket of the ironing board cover. The layer of scorch resistant material may alternatively be secured directly to the ironing board cover with snaps. Where the layer of scorch resistant material is provided in the pocket, the scorch resistant material is not flush with the cover. The user cannot freely slide the iron onto and off of the safety panel without lifting the iron.

U.S. Pat. No. 2,267,112 to Kovalik shows an ironing board covering in which a layer of scorch resistant material has been fastened to the top of the cover with a binding strip. The binding strip surrounds the scorch resistant material and overlaps with the cover. The overlapping sections are then sewn into the cover to secure the scorch resistant material. The scorch resistant material is not flush with the ironing board cover.

U.S. Pat. No. 2,458,698 to Galbraith shows an ironing board cover having a pad structure for resting a hot iron thereon. The pad structure is provided in a frame over the ironing board cover. The frame surrounds all four sides of the pad structure. The frame prevents a user from freely sliding the iron onto and off of the pad structure.

U.S. Pat. No. 2,850,817 to Rudd et al. shows an ironing board cover that includes an ironing pad secured to the cover by folding the cover material downward to form pleats, which define the edges of a pocket. The pad is inserted into the pocket. The ironing pad is not flush with the cover material.

U.S. Pat. No. 3,636,644 to Janetzke shows an ironing board cover that includes a strip of non-scorch material for resting a hot iron. The non-scorch material extends entirely across the ironing board in the vicinity of the heel of an ironing board. The non-scorch material is secured to the ironing board cover by stitching. A disadvantage of this design is that the iron may easily slide over the edges of the ironing board. Falling over the edge of an ironing board is one of the most common causes of broken irons.

U.S. Pat. No. 3,911,603 to Lehrman shows an ironing board cover that includes a heat resistant padding bonded to the cover. The heat resistant pad is not provided with any enclosures to prevent an iron from sliding over the edge of the ironing board.

SUMMARY OF THE INVENTION

A number of disadvantages of previous designs have been discussed above. Accordingly, in recognition of and intending to overcome the foregoing problems, the invention relates generally to an ironing board cover assembly for covering an ironing board having a narrow nose portion and a heel portion. The ironing board cover assembly includes an ironing board cover and a scorch resistant panel disposed at one end of the ironing board cover. The scorch resistant panel is characterized by having a perimeter secured to the ironing board cover, which forms a pocket between the cover and panel.

The ironing board cover assembly further includes a heat resistant panel located in the pocket between the scorch resistant panel and the ironing board cover. The purpose of the heat resistant panel is to resist heat penetration from the iron into the ironing board cover and pad. Additionally, the cover assembly provides a bumper having a height of at least ⅓" (8.46 mm) around a portion of the perimeter of the scorch resistant panel to partially surround said scorch resistant panel. The purpose of the bumper is to prevent an iron from falling over the edge of the ironing board. The ironing board cover assembly is fabricated so that an individual may freely slide an iron onto the scorch resistant panel without lifting the iron onto its end.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown therein.

DETAILED DESCRIPTION OF THE INVENTION

Figure 1:
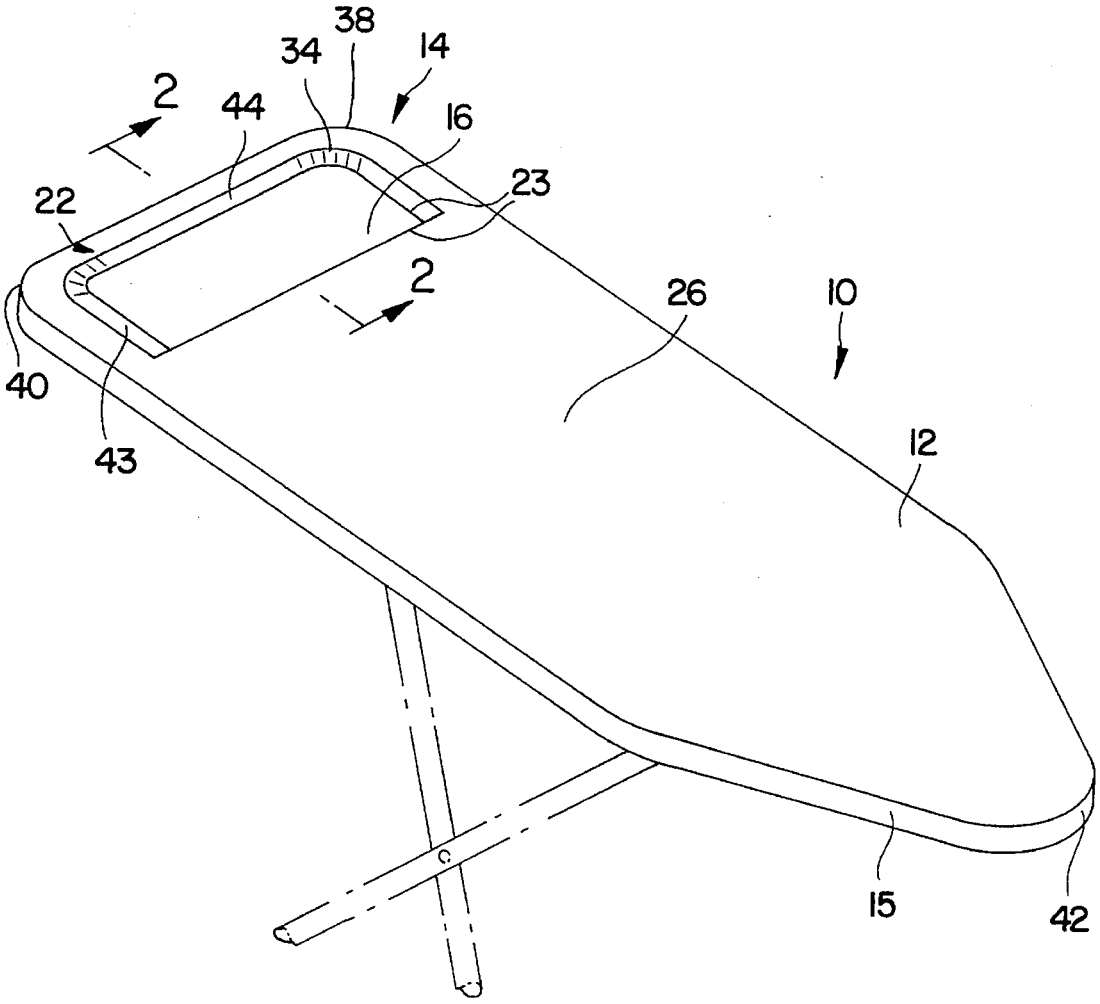
FIG. 1 is a perspective view of the ironing board cover and an ironing board (in phantom lines).

Referring to the drawings in detail, where like numerals indicate like elements, there is illustrated a device in accordance with the present invention designated as ironing board cover assembly 10 shown generally in FIG. 1. Cover assembly 10 comprises a cover or fabric layer 12 which has the general outline of a typical ironing board (not shown) having a narrow nose portion and a heel portion. The ironing board cover's edges 15 extend past the edges of the ironing board. Preferably, fabric layer 12 is made from a suitable material which resists the heat and pressure normally applied during ironing. Examples of such fabrics include cotton, either bleached, unbleached, dyed, coated, or in its natural loom state. Such fabrics are well known in the art and are readily available commercially. Thus, they will not be described in detail.

Figure 2:
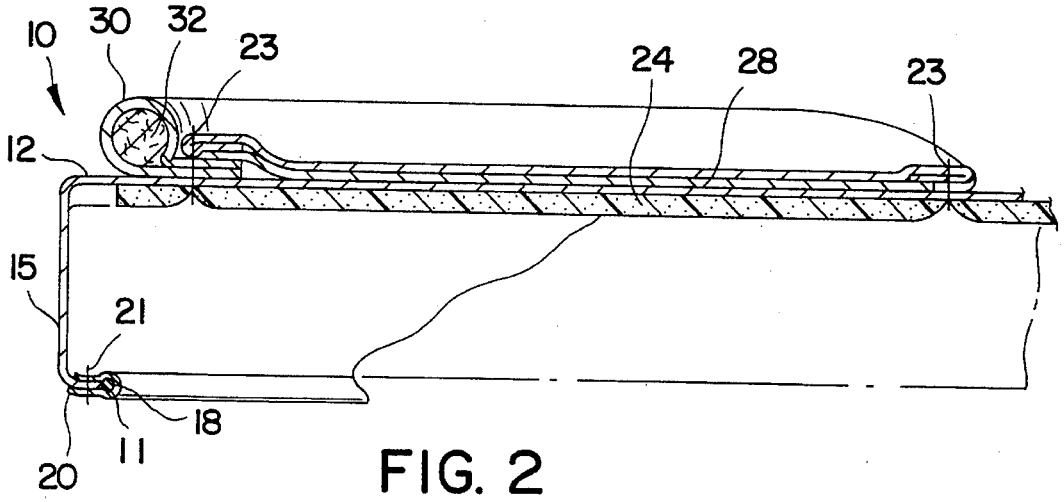
FIG. 2 is a side sectional view of the ironing board cover.

The edges 15 of fabric layer 12 may have a binding 11 through which a drawstring 18 is run as best seen in FIG. 2. The binding 11 comprises a strip of material 20 which is doubled over the edge of fabric layer 12. Stitching 21 is provided over the doubled over strip of material 20 and along the edge of fabric 12 to provide a conduit for housing the drawstring 18.

Padding 24, having generally the same shape as fabric layer 12, may be provided on the underside of fabric layer 12. Padding 24 is preferably a layer of foam polymeric material such as foam polyurethane and is approximately 1.4 inches (35.6 mm) thick. Padding 24 is substantially thicker than fabric layer 12. However, the edges of the padding 24 are coextensive with and uniformly spaced from the edges 15 of the ironing board cover to form the cover having a uniform margin.

Padding 24 may be provided separately or secured to fabric 12 by an adhesive as described hereinafter. If padding 24 is secured to fabric 12, the preferred adhesive is a thermoplastic polymer material with heat reactive cross linking groups such as NACRYLIC X-4260 (trademark) which is a sel-freactive acrylic copolymer latex. Such adhesive has a clarity of water white, a solids content of 51 percent, a pH of 3.5, an average particle size of 0.18 microns (0.18 micrometers), an anionic particle charge, excellent stability, a density of 8.8 lbs/gallon (1054.5 Kg/m$^3$) and excellent water and solvent resistance.

Ironing board cover assembly 10 is further characterized by having a safety panel 14 provided thereon. Safety panel 14 may have any geometrical shape that provides sufficient space for resting a horizontally oriented iron thereon. A generally square or rectangular shape is preferred. Safety panel 14 includes a scorch and abrasion resistant pad 16 and a bumper 22 attached, such as by stitching, to fabric layer 12 along the perimeter of safety panel 14.

Safety panel 14 shown in FIG. 1 has a generally square or rectangular configuration. Hence, bumper 22 has been shown in FIG. 1 as bounding three sides of the perimeter of safety panel 14, which forms a U-shaped bumper 22 having two side sections 43 and a base section 44. Side sections 43 and base section 44 define three bounded sides and terminate to define an opening in bumper 22 surrounding safety panel 14, which opening or unbounded side faces the nose of the ironing board and work area 26 of ironing board cover assembly 10. Safety panel 14 lies essentially flush with the fabric layer 12 along the opening as the safety panel 14 is stitched to fabric layer 12.

The scorch resistant pad 16 is secured to fabric layer 12 by stitching 23. Scorch resistant pad 16 may be a layer of woven fabric made from synthetic fibers having a high scorching or charring temperature, preferably at least about 700° F.(371° C.). Synthetic fibers, as used herein, refers to man-made organic polymeric fibers. Examples of suitable synthetic fibers are aromatic polyamides, also known as aramids. A aromatic polyamide fiber is understood by those skilled in the art to be a manufactured fiber in which the fiber-forming substance is a long-chain synthetic polyamide in which at least 85% of the amide linkages are attached directly to two aromatic rings. Preferred synthetic fibers include, for example, poly(m-phenylene isophthalamide), available from E. I. dupont de Nemours as Nomex®. The woven fiber is further characterized by having a weight of 0.404 lbs per linear yard (200 Kg/m), 41 picks by 46 ends, and a charring temperature of about 700° F. (371° C.).

An intermediate heat insulating layer 28 may be provided between scorch resistant pad 16 and fabric layer 12. The purpose of intermediate layer 28 is to resist heat penetration from the iron into fabric layer 12 and pad 24.

Intermediate layer 28 may include a thin layer of insulating material. An example of a preferred insulating material is aluminum in the form of a thin flat plate. Such an aluminum metal plate preferably has dimensions substantially equal to scorch resistant pad 16 and a thickness of approximately 0.010 inches (0.254 mm). Said thickness provides adequate heat insulation and does not interfere with the free sliding movement of an iron from working surface 26 onto safety panel 14.

Bumper 22 is sewn onto ironing board cover assembly 10. Bumper 22 is provided along the perimeter of safety panel 14 while leaving an opening in the direction of the ironing board nose to permit a user to slide an iron onto safety panel 14 from working surface 26. A single bumper 22 may be provided along the perimeter of safety panel 14. Alternatively those skilled in the art will recognize that three straight and separate bumpers 22 may be provided around the three sides of a square or rectangular safety panel 14 shown in FIG. 1. A combination of these methods may also be employed depending upon the shape of safety panel 14.

Bumper 22 comprises a binding formed from a strip of fabric 30 folded back onto itself. Stitching 23 secures fabric 30 back onto itself and to fabric layer 12, thus forming a fixed binding having a central core and closed ends. Fabric 30 may be made from the same synthetic fiber used to make scorch resistant pad 16. However, it is not essential that fabric 30 be scorch resistant because only the sides of an iron should come in contact with bumper 22. Hence, fabric 30 may be made from other well-known material, such as cotton, or synthetic fabrics or mixtures thereof.

Fill material 32 is provided in the central core of the binding formed by fabric 30. Fill material 32 may be any flexible natural or man-made material capable of forming a firm bumper 22. A firm bumper 22 is characterized by compressing less than one-third of its diameter under the weight of an iron. Additionally, a firm bumper 22 is characterized by returning to substantially its original size and shape once a compressive force is removed therefrom.

Fill material 32 should also be capable of bending when placed under stress to form a corner member 34. The fill material need not be capable of bending to form corner member 34 if straight and separate bumpers 22 are used to enclose the perimeter of safety panel 14. Fill material 32 is preferably ½ inch (12.7 mm) fibercore fill. The height of bumper 22 is preferably between ⅓ inch (8.46 mm) to about 1 inch, more preferably from about ½ inch (12.7 mm) to about ¾ of an inch (19.05 mm). The most preferred height is about ⅝ of an inch (15.88 mm).

When installed on an ironing board, the padding 24, as shown in FIG. 1, is coextensive with the edges of the ironing board. When drawstring 18 is tightened, binding 11 is snugly held on the under surface of the ironing board. The absence of padding 24 from the sides 15 of the ironing board cover assembly 10 enables to cover assembly 10 to be securely tightened on the ironing board. Further, there is no bunching or gathering of the padding 24 at corners 38 and 40, nor at tip 42, or at any point of the perimeter of the ironing board. It is apparent that if padding 24 were coextensive with fabric layer 12 bunching results.

As described above, padding 24 may be provided separately or adhesively bonded to the ironing board cover. In the event that padding 24 is to be adhesively bonded to the ironing board cover, the preferred method involves the use of thermoplastic adhesive applied to one face of padding 24 by conventional applicator rollers or the like. The padding 24 may be placed upon any suitable tray or surface (not shown) adapted to be reciprocated into a press (not shown). The fabric layer 12 is placed over the padding 24 and is positioned so that the edges 15 of the ironing board cover define a uniform margin between the outer peripheral edge of the padding 24 and the outer peripheral edge of the fabric layer 12.

The tray or surface having fabric layer 12 and padding 24 thereon is reciprocated into a conventional press. The top platen of the press is heated to a temperature of approximately between 300° F. (149° C.) to 450° F. (232° C.) with a preferred temperature being about 425° F. (218° C.). Minimal pressure is applied when the platen is brought into contact with the outer face of fabric layer 12. It is important that the pressure be minimal in order to avoid substantial compression of padding 24. Only the top 1/16 inch (15.8 mm) to 1/8 inch (3.18 mm) of padding 24 should be compressed so that the desired thickness of padding 24 is maintained. The exact pressure applied depends upon the type of padding 24 used and may be easily visually determined by noting the pressure required to effect the desired minimum compression of padding 24. Excessive pressure results in crushing of padding 24 during the bonding and curing steps with the adhesive being forced through padding 24 and preventing padding 24 from recovering its original shape thereby resulting in an unacceptable ironing board cover assembly 10.

The top platen is held in place for approximately 3–8 seconds while the adhesive is cured with the optimum curing time being 5 seconds. No heat is applied through the bottom of padding 24 since such heat adversely affects padding 24 during bonding. The preferred adhesive softens at approximately 200° F. (93° C.) to about 250° F. (121° C.).

The present invention may be embodied in other specific forms without departing from the spirit or essential attributes thereof and, accordingly, reference should be made to the appended claims, rather than to the foregoing specification, as indicating the scope of the invention.

I claim:

1. An ironing board cover assembly for covering an ironing board having a narrow nose portion and a heel portion comprising:

a) an ironing board cover;

b) a scorch resistant panel disposed at one end of said ironing board cover, said scorch resistant panel having a perimeter secured to the ironing board cover to form a pocket between said ironing board cover and panel;

c) a heat resistant panel located in the pocket between the scorch resistant panel and the ironing board cover; and d) a bumper having a height of at least 1/3 of an inch (8.46 mm) attached to said ironing board cover around a portion of the perimeter of the scorch resistant panel to partially surround said scorch resistant panel for preventing the iron from sliding off the scorch resistant panel.

2. An ironing board cover assembly as defined in claim wherein the ironing board cover is formed of a material selected from the group consisting of bleached cotton, unbleached cotton, dyed cotton, coated cotton, natural loom cotton, and mixtures thereof.

3. An ironing board cover assembly as defined in claim 1 wherein the scorch resistant panel is formed of synthetic fibers having a charring temperature of at least about 700° F. (371° C.).

4. An ironing board cover assembly as defined in claim 1 wherein the scorch resistant panel is a woven fiber in which the fiber is formed from a long-chain synthetic polyamide having amide linkages in which at least 85% of the amide linkages are attached directly to two aromatic rings.

5. An ironing board cover assembly as defined in claim 4 wherein the scorch resistant panel is formed of woven fibers of poly(m-phenylene isophthalamide).

6. An ironing board cover assembly as defined in claim 1 wherein the heat resistant panel is formed of aluminum.

7. An ironing board cover assembly as defined in claim 1 wherein the bumper has a height between from about 1/3 inch (8.46 mm) to about 1 inch (25.4 mm).

8. An ironing board cover assembly as defined in claim 1 wherein the bumper has a height between from about 1/2 inch (12.7 mm) to about 3/4 of an inch (19.05 mm).

9. An ironing board cover assembly as defined in claim 1 wherein the scorch resistant panel has a generally rectangular shape and is surrounded on three sides by the bumper.

10. An ironing board cover assembly as defined in claim 1 wherein the scorch resistant panel is located in the vicinity of the heel portion of the ironing board and the scorch resistant panel has a generally rectangular shape and has three bounded sides and an unbounded side, wherein said unbounded side is closest to the nose portion of the ironing board.

11. An ironing board cover assembly for covering an ironing board having a narrow nose portion and a heel portion comprising:

a) a fabric layer;

b) a scorch resistant panel disposed at one end of said fabric layer, said scorch resistant panel having a perimeter secured to the fabric layer to form a pocket between said fabric layer and panel;

c) a heat resistant panel located in said pocket between the scorch resistant panel and the fabric layer;

d) a heat resistant padding which is substantially thicker than said fabric layer, said heat resistant padding including a top surface and a bottom surface of substantially the same size and shape as the surface of the ironing board to be covered, said fabric layer covering substantially the entire area of the top surface of said heat resistant padding; and e) a U-shaped bumper including two side sections and a base section secured to the perimeter of the scorch resistant panel to partially surround said scorch resistant panel, said U-shaped bumper having a height of at least 1/3 of an inch (8.46 mm) for preventing the iron from sliding off the scorch resistant panel.

12. An ironing board cover assembly as defined in claim 11 wherein the fabric layer is formed of a bleached cotton, unbleached cotton, dyed cotton, coated cotton, natural loom cotton, or mixtures thereof.

13. An ironing board cover assembly as defined in claim 11 wherein the scorch resistant panel is formed of synthetic fibers having a charring temperature of at least about 700° F. (371° C.).

14. An ironing board cover assembly as defined in claim 11 wherein the scorch resistant panel is a woven fiber in which the fiber is formed from a long-chain synthetic polyamide having amide linkages in which at least 85% of the amide linkages are attached directly to two aromatic rings.

15. An ironing board cover assembly as defined in claim 14 wherein the scorch resistant panel is formed of woven fibers of poly(m-phenylene isophthalamide).

16. An ironing board cover assembly as defined in claim 11 wherein the heat resistant panel is formed of aluminum.

17. An ironing board cover assembly as defined in claim 11 wherein the U-shaped bumper has a height between from about 1/3 inch (8.46 mm) to about 1 inch (25.4 mm).

18. An ironing board cover assembly as defined in claim 11 wherein the U-shaped bumper has a height between from about 1/2 inch ()12.7 mm) to about 3/4 of an inch (19.05 mm).

19. An ironing board cover assembly as defined in claim 11 wherein the scorch resistant panel is generally rectangular and the U-shaped bumper surrounds the scorch resistant panel on three sides.

20. An ironing board cover assembly as defined in claim 11 wherein the scorch resistant panel is located in the vicinity of the heel portion of the ironing board, the side and base sections of the U-shaped bumper defining a bounded portion of the scorch resistant panel and wherein an unbounded side of the scorch resistant panel is located closest to the nose portion of the ironing board.

21. An ironing board cover assembly as defined in claim 11 wherein said fabric layer is adhesively bonded to the top surface of said heat resistant padding.

22. An ironing board cover assembly for covering an ironing board having a narrow nose portion and a heel portion comprising:

an ironing board cover;

a scorch resistant fabric layer attached to the ironing board cover at a location proximate to an end, the attachment of the scorch resistant fabric to the ironing board cover forming a pocket;

a heat resistant member disposed within the pocket formed between the scorch resistant fabric and the ironing board cover; and a raised bumper disposed around at least a portion of the periphery of the scorch resistant fabric so as to partially surround the scorch resistant panel, the raised bumper having a height substantially greater than the height of the scorch resistant panel so as to form a barrier for preventing an iron from being slid laterally off the scorch resistant fabric past the bumper.

* * * * *